US007841593B2

(12) United States Patent
Toba et al.

(10) Patent No.: US 7,841,593 B2
(45) Date of Patent: Nov. 30, 2010

(54) SHEET TRANSPORT APPARATUS AND IMAGE FORMING APPARATUS

(75) Inventors: Takakiyo Toba, Kanagawa (JP); Hiroatsu Kazama, Kanagawa (JP); Takuya Ito, Kanagawa (JP); Nobutoshi Hamasaki, Kanagawa (JP); Kouta Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/111,409

(22) Filed: Apr. 29, 2008

(65) Prior Publication Data

US 2009/0115123 A1 May 7, 2009

(30) Foreign Application Priority Data

Nov. 7, 2007 (JP) ..... 2007-289745

(51) Int. Cl.
*B65H 3/52* (2006.01)

(52) U.S. Cl. ..... 271/121; 271/122; 271/125

(58) Field of Classification Search ..... 271/121, 271/122, 125
See application file for complete search history.

(56) References Cited

U.S. PATENT DOCUMENTS

| | | | | |
|---|---|---|---|---|
| 5,435,537 | A * | 7/1995 | Gysling | 271/10.05 |
| 6,129,347 | A * | 10/2000 | Brooks et al. | 271/22 |
| 6,932,337 | B2 * | 8/2005 | Taniyama | 271/122 |
| 7,384,034 | B2 * | 6/2008 | Nagura et al. | 271/125 |
| 7,427,060 | B2 * | 9/2008 | Taniyama | 271/122 |
| 2002/0074712 | A1 * | 6/2002 | Yano | 271/121 |
| 2003/0160381 | A1 * | 8/2003 | Sonoda et al. | 271/121 |
| 2006/0157913 | A1 * | 7/2006 | Sonoda et al. | 271/121 |
| 2008/0224382 | A1 * | 9/2008 | Sonoda et al. | 271/125 |

FOREIGN PATENT DOCUMENTS

| | | | |
|---|---|---|---|
| JP | 45-14724 | Y | 6/1970 |
| JP | 46-968 | Y | 1/1971 |
| JP | 57-140769 | U | 2/1981 |
| JP | 60-149312 | U | 10/1985 |
| JP | 1-78635 | U | 5/1989 |
| JP | 5197239 | A | 8/1993 |
| JP | 10279098 | A | 10/1998 |
| JP | 2001-106371 | A | 4/2001 |
| JP | 2002-060074 | A | 2/2002 |
| JP | 2002-167067 | A | 6/2002 |

OTHER PUBLICATIONS

Japanese Office Action, corresponding to JP Appln. No. 2007-289745, dated Dec. 15, 2009.

* cited by examiner

*Primary Examiner*—David H Bollinger
(74) *Attorney, Agent, or Firm*—Sughrue Mion, PLLC

(57) ABSTRACT

The sheet transport apparatus comprise a sheet supply tray, a separation roll, a support body and a separation roll accommodation portion. The sheet supply tray has a plurality of sheets. The separation roll separates out the sheets one by one by applying a transport resistance to the sheets transported from the sheet supply tray. The support body rotatably supports the separation roll. The separation roll accommodation portion is formed in a transport path along which the sheets are transported, and it accommodates the separation roll and the support body such that they may be detached from a transport surface side of the transport path.

22 Claims, 9 Drawing Sheets

SHEET TRANSPORT APPARATUS AND IMAGE FORMING APPARATUS

CROSS-REFERENCE TO RELATED APPLICATION

This application is based on and claims priority under 35 USC 119 from Japanese Patent Application No. 2007-289745 filed Nov. 7, 2007.

BACKGROUND

1. Technical Field

The present invention relates to a sheet transport apparatus and an image forming apparatus.

2. Related Art

A document automatic feeding apparatus as a sheet transport apparatus, is provided with a separation roll which reversely rotates and contacts with a feeding belt, which feeds a document on a document input tray downstream, thereby separating out copies one by one, and a guide member attached to a space which is adjacent in a thrust direction of the separation roll and which guides the transported document.

Further, the document automatic feeding apparatus is configured such that leading ends of a snap fit for attaching and detaching a guide member are attached to notches in end portions of a rotational drive shaft so as to double as a stopper of a separation roll, and the snap fits, which have different distances to the leading ends thereof are attached to a column member of a support member fixed to a bottom surface of a space.

SUMMARY

The present invention is provided to reduce the space needed for a separation roll when it is being attached and detached, compared to a structure in which the separation roll is moved in an axial direction when being attached and detached.

In accordance with an aspect of the invention, there is provided a sheet transport apparatus including: a sheet supply tray which can have a plurality of sheets; a separation roll that separates out the sheets one by one by applying a transport resistance to the sheets transported from the sheet supply tray; a support body rotatably supporting the separation roll; and a separation roll accommodation portion formed in a transport path along which the sheets are transported, and accommodating the separation roll and the support body such that they may be detached from a transport surface side of the transport path.

BRIEF DESCRIPTION OF THE DRAWINGS

Exemplary embodiments of the present invention will be described in detail based on the following figures, wherein.

DETAILED DESCRIPTION

A description will be given below of an exemplary embodiment in accordance with the present invention with reference to the accompanying drawings.

(Structure of Image Forming Apparatus in Accordance with Exemplary Embodiment)

Figure 1:
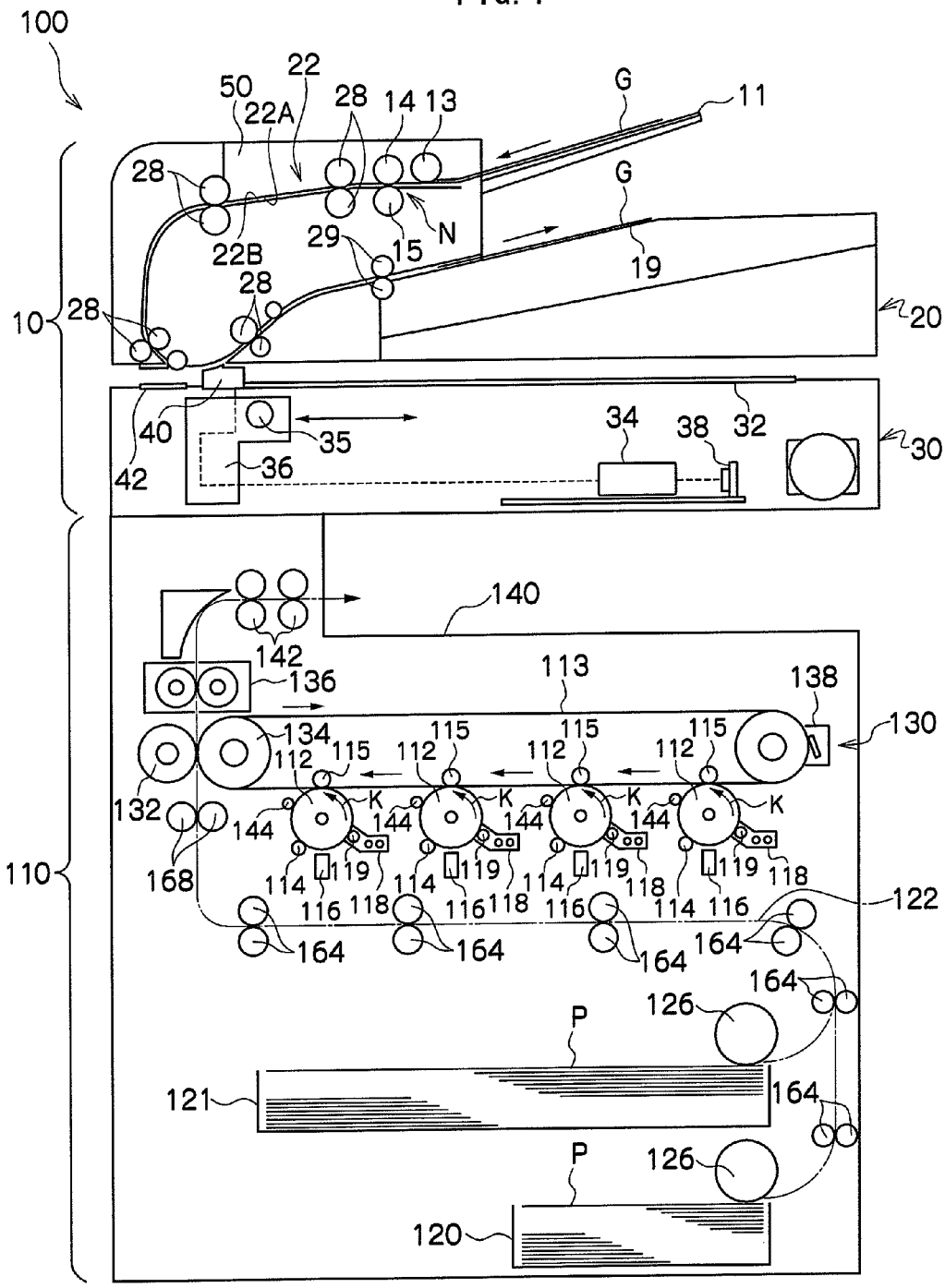
FIG. 1 is a schematic view showing a structure of an image forming apparatus in accordance with an exemplary embodiment of the present invention.

First, a description will be given of a structure of an image forming apparatus in accordance with the exemplary embodiment. FIG. 1 is a schematic view showing the structure of the image forming apparatus in accordance with the exemplary embodiment.

An image forming apparatus 100 in accordance with the exemplary embodiment comprises an image recording apparatus 110 recording an image on a recording medium P such as a paper or the like, and an image reading apparatus 10 feeding a document and reading an image of the document.

The image reading apparatus 10 is provided in an upper portion of the image forming apparatus 100, and the image recording apparatus 110 is provided in a lower portion of the image forming apparatus 100.

The image reading apparatus 10 is structured so as to read the image of the document, and convert the read image into an image signal. The image recording apparatus 110 is structured so as to record the image on the recording medium P on the basis of the image signal converted by the image reading apparatus 10.

A description will be given here of a structure of the image recording apparatus 110 in accordance with the exemplary embodiment.

The image recording apparatus 110 in accordance with the exemplary embodiment comprises plural recording medium accommodation portions 120 and 121 accommodating the recording medium P, in a lower portion thereof, as shown in FIG. 1.

The recording mediums P being different sizes are respectively accommodated in the recording medium accommodation portions 120 and 121. For example, the recording mediums P of B5 size are accommodated in the recording medium accommodation portion 120, and the recording mediums P of B4 size are accommodated in the recording medium accommodation portion 121.

A delivery roll 126 is arranged just above a leading end side (a right end side in FIG. 1) of the recording medium accommodation portions 120 and 121. The delivery roll 126 rotates while coming into contact with a leading end side of a top surface of the recording medium P, and delivers the recording medium P from the recording medium accommodation portions 120 and 121.

A transport path 122 is formed within the image recording apparatus 110. The transport path 122 extends out of the leading end portions of the recording medium accommodation portions 120 and 121, is curved as an S-shape form, and extends toward an upper portion of the image recording apparatus 110.

A plurality of (for example, six) transport roll pairs 164, and a resist roll 168 are arranged in sequence along the transport path 122 from an upstream side in the transport direction of the recording medium. The transport roll pairs 164 nip and feed the recording medium P.

An image recording portion 130 recording the image onto the recording medium P is arranged above the recording medium accommodation portion 121.

The recording medium P accommodated in the recording medium accommodation portions 120 and 121 is delivered by the delivery roll 126, and is transported along the transport path 122 by the transport roll pairs 164 and the resist roll 168 so as to be transported to the image recording portion 130.

The image recording portion 130 is structured so as to form a color image on the recording medium P delivered from the recording medium accommodation portions 120 and 121, by using respective color toners of cyan, magenta, yellow and black.

Four photoreceptor drums 112 are rotatably arranged side by side in the image recording portion 130. Each of the photoreceptor drums 112 is rotated in a direction of an arrow K by a driving portion (not shown).

A charged roller 114 is arranged in a left oblique lower side of each of the photoreceptor drums 112 in such a manner as to come into contact with the photoreceptor drum 112. The charged roller 114 charges a surface of the photoreceptor drum 112 at a predetermined electric potential.

After charging, an exposure is carried out by a light emitted from each of exposure heads 116 arranged below each of the photoreceptor drum 112, and a latent image is formed on the surface of the photoreceptor drum 112 in response to the image signal converted by the image reading apparatus 10.

Each of the color toners charged at a predetermined polarity is retained in a developing roller 119 of each development device 118. The latent image formed on the surface of each of the photoreceptor drums 112 is developed by applying a development bias to the developing roller 119 so as to come to a toner image of each of the colors.

The respective color toner images respectively formed on four photoreceptor drums 112 are transferred onto an intermediate transfer belt 113 arranged above the respective photoreceptor drums 112 by a first transfer roller 115, and are superposed on the intermediate transfer belt 113 so as to form a full-color toner image.

The recording medium P outputted from the recording medium accommodation portions 120 and 121 and transported by the transport roll pair 164 is fed to a portion between a second transfer roller 132 and an intermediate transfer roller 134 at a predetermined timing by a resist roll 168, and the full-color toner image is transferred to the recording medium P. In this case, the toner image is transferred to the surface of the recording medium P in a side of the intermediate transfer roller 134.

The recording medium P to which the full-color toner image is transferred is fed to a fixing device 136. The fixing device 136 fixes the toner image on the recording medium P on the basis of a heat and a pressure. The recording medium P on which the toner image is fixed is delivered to a paper output tray 140 by a delivery roller 142.

In this case, all of the toner image is not transferred to the intermediate transfer belt 113 and the recording medium P, but a part of the toner image remains as a residual toner in the photoreceptor drum 112 and the intermediate transfer belt 113. The residual toner on the photoreceptor drum 112 is removed by a cleaning roll 144, and the residual toner on the intermediate transfer belt 113 is removed by a cleaning apparatus 138.

(Structure of Image Reading Apparatus in Accordance with Exemplary Embodiment)

Next, a description will be given of a structure of an image reading apparatus in accordance with the exemplary embodiment.

The image reading apparatus 10 in accordance with the exemplary embodiment comprises a document transport apparatus 20 feeding a document G, as one example of a sheet transport apparatus feeding a sheet.

In this case, the sheet transport apparatus is not limited to a structure feeding a document corresponding a reading subject of the image, but may be constituted by a structure feeding the recording medium on the which the image is recorded. Further, as the sheet transport apparatus, there may be employed a sheet transport apparatus which feeds the sheet for the other purpose except for the purpose of reading the image or recording the image, or may be employed a sheet transport apparatus which feeds the sheet for simply aiming to feed the sheet.

Further, the sheet which is fed by the sheet transport apparatus is not limited to the paper, but may employ a plastic film, and the other sheet-like materials.

The image reading apparatus 10 in accordance with the exemplary embodiment comprises an image reading portion 30 reading an image of the document G fed by the document transport apparatus 20. The document transport apparatus 20 is provided in an upper portion of the image reading apparatus 10, and the document reading portion 30 is provided in a lower portion of the image reading apparatus 10.

The image reading portion 30 comprises an image input portion 36 having a light source 35 and an optical system such as a mirror or the like, a contracting optical system 34 constituted by an optical system such as an image forming lens or the like, and an image reading device 38 constituted by a CCD or the like.

The image input portion 36 is structured so as to irradiate the light to the document G from the light source 35. The irradiation light irradiated from the light source 35 is reflected from the document G. The reflection light reflected by the document G is incident to the image input portion 36. The light being incident to the image input portion 36 is guided to the contracting optical system 34 by the optical system such as the mirror or the like in the image input portion 36.

The light guided to the contracting optical system 34 is contracted by the contracting optical system 34 so as to form image to the image reading device 38. The light forming image in the image reading device 38 is read by the image reading device 38.

Further, the document transport apparatus 20 in accordance with the exemplary embodiment comprises a input document tray 11 which may accommodate plural copies Q as one example of a sheet supply tray which may have plural sheets. The document tray 11 may be moved up and down by an elevating mechanism (not shown).

A delivery roll 13 coming into contact with a leading end side of a top surface of the document G and feeding the document G from the document tray 11 is arranged just above a leading end side (a left end side in FIG. 1) of the document tray 11.

A transport path 22 extending from the leading end portion of the document tray 11 and curved as a C-shaped form is formed within the document transport apparatus 20. The document transport path 22 is formed by a transport path surface 22A in an upper portion side, and a transport path surface 22B in a lower portion side.

A transport roll 14 feeding the document G inputted from the document tray 11 to a downstream side in a document transport direction is arranged in a downstream side to the document transport direction of the delivery roll 13 in an upper portion side of the transport path 22.

A separation roll 15 opposing to the transport roll 14 in a lower position of the transport roll 14 is arranged in a downstream side to the document transport direction of the delivery roll 13 in the lower portion side of the transport path 22. The separation roll 15 comes into contact with the transport roll 14, and a nip portion N nipping the document G fed from the document tray 11 is formed between the transport roll 14 and the separation roll 15.

The transport roll 14 is rotated around an axial direction which is orthogonal to the document transport direction, by a driving control portion (not shown), and a rotational drive of the transport roll 14 is controlled. Since the transport roll 14 comes into contact with a top surface (a surface) of the document G which is fed from the document tray 11 and guided to the nip portion N so as to rotationally drive, the document G is transported to the downstream side.

Figure 3:
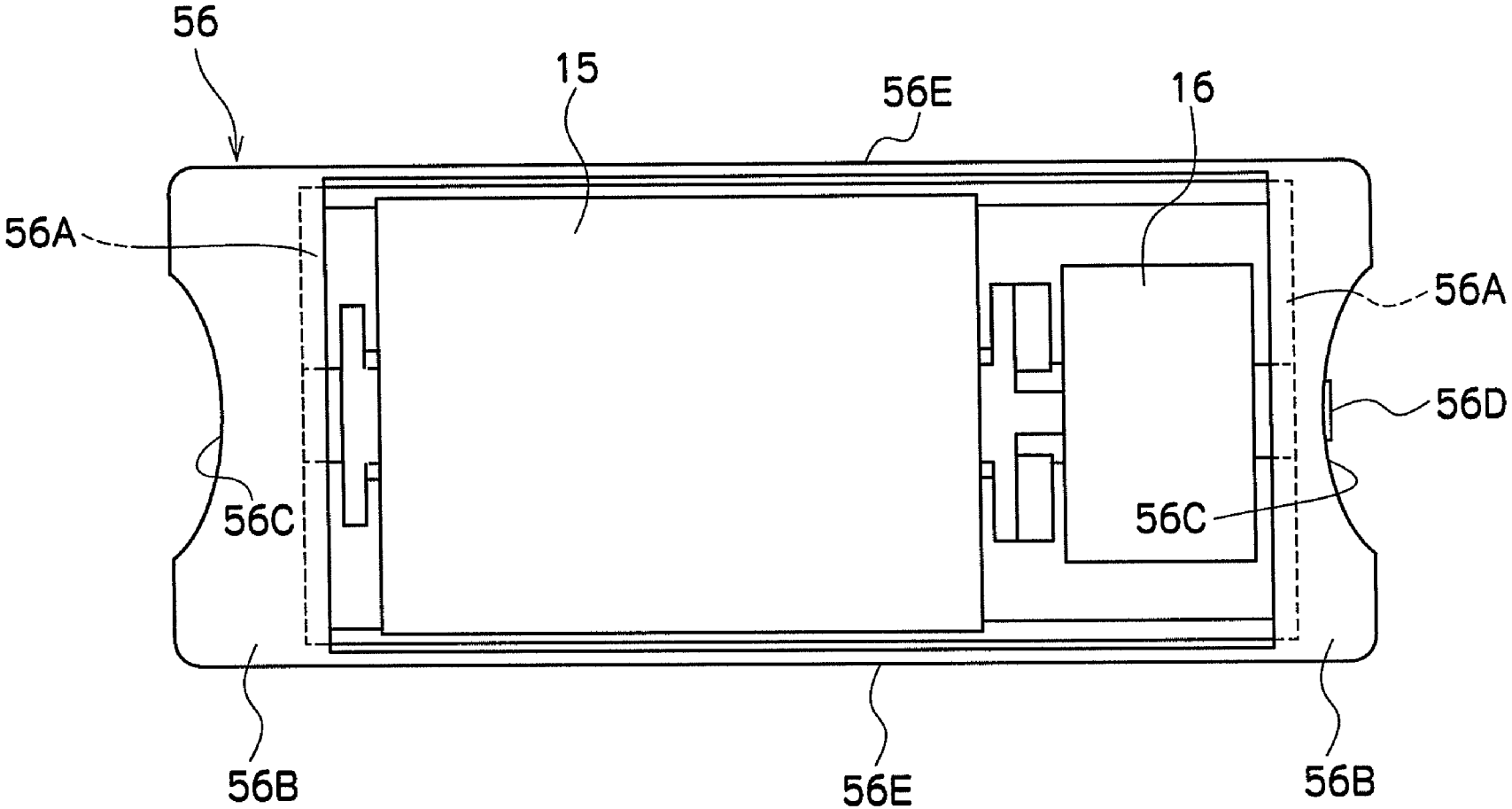
FIG. 3 is a top view of a separation roll unit in accordance with the exemplary embodiment.
Figure 4:
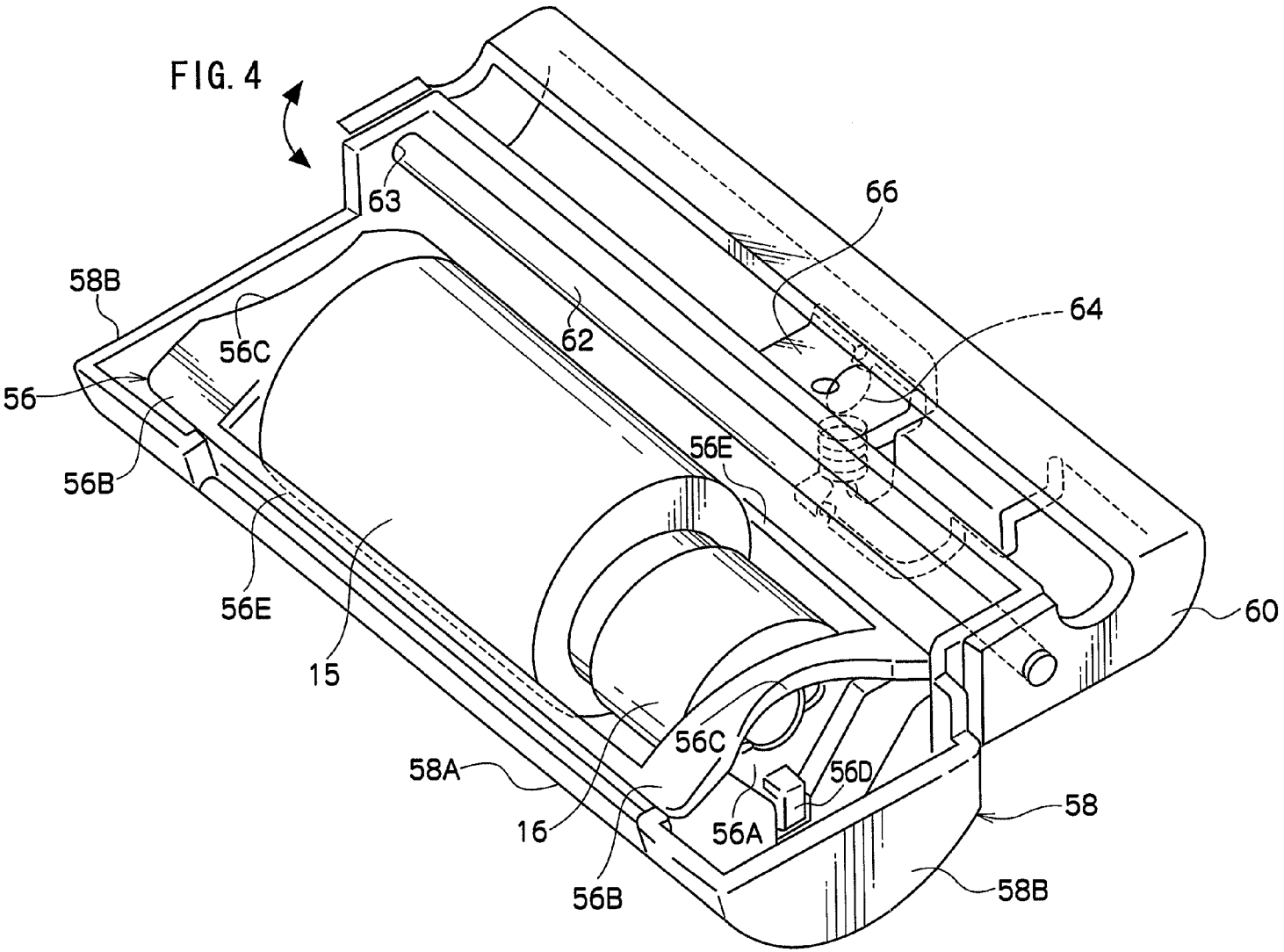
FIG. 4 is a perspective view showing an accommodation container in which the separation roll unit in accordance with the exemplary embodiment is accommodated, and a support frame supporting the accommodation container so as to freely rotate.
Figure 5:
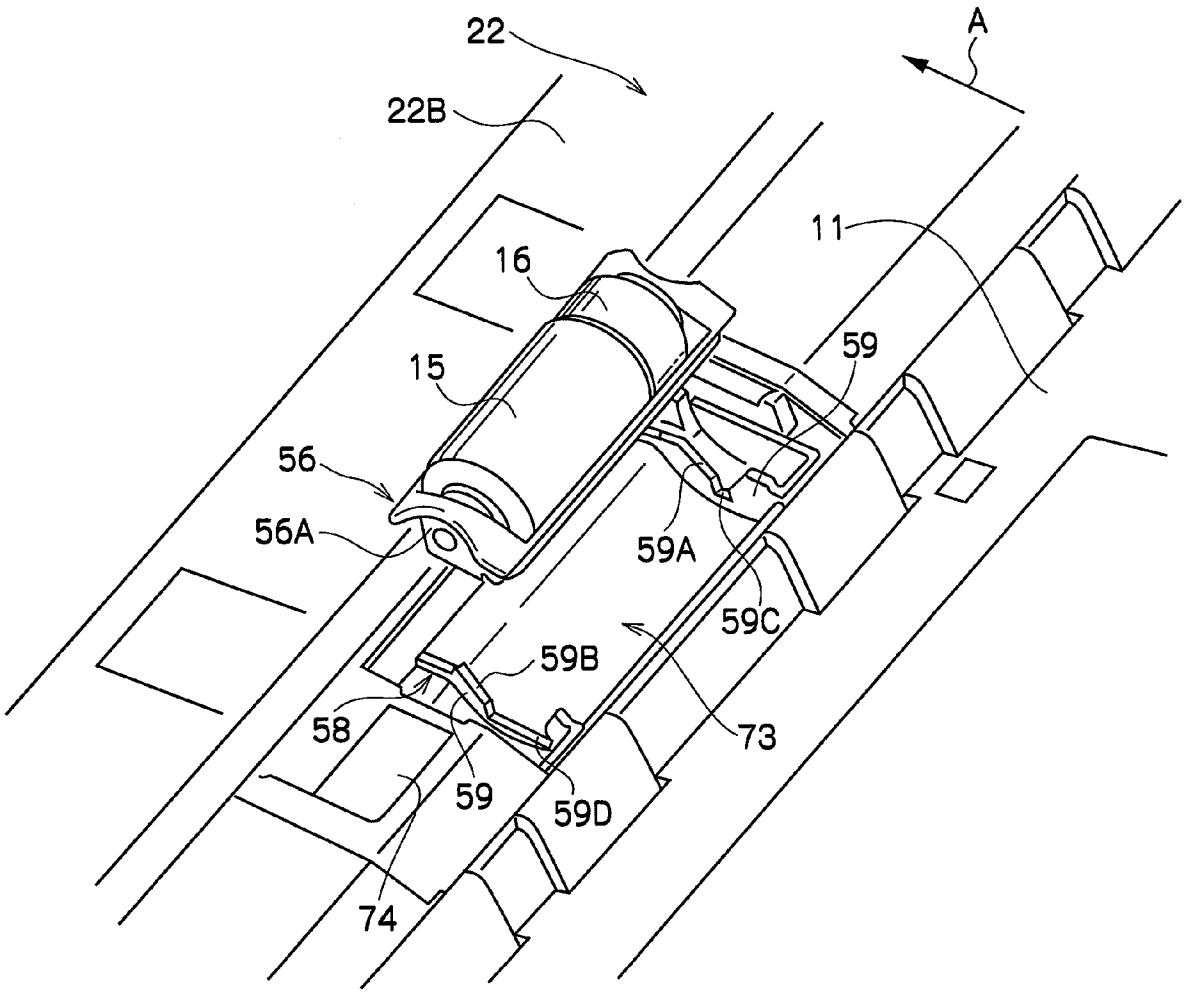
FIG. 5 is a perspective view showing a state in which the separation roll unit constituted by a separation roll and a support body in accordance with the exemplary embodiment is detached from the accommodation container.

A torque limiter 16 is attached to a rotation axis of the separation roll 15 (refer to FIGS. 3, 4 and 5). Accordingly, in the case that one document G is guided to the nip portion N, and is fed to the transport roll 14. Then, the separation roll 15 is given to a predetermined or more torque by the document G, and the separation roll 15 is rotated in accordance with the document G on the basis of an operation of the torque limiter 16.

In the case that plural of copies G of the document tray 11 are fed overlappingly to the nip portion N, the transport roll 14 applies a transport force to the upper side document G (first document G), and the lower side document G (second document G) applies a transport resistance by the separation roll 15. In other words, the overlapping copies G are separated into one by the transport roll 14 and the separation roll 15 so as to be fed one by one, and a overlapping feeding of the document G is inhibited.

In this case, the separation roll 15 in accordance with the exemplary embodiment is constituted by a driven roll which a driving force does not apply to and is rotated in a driven manner. However, the separation roll 15 may be structured by a drive roll to which the driving force is applied.

Further, a plurality of transport roll pairs 28 nipping and feeding the document G along a transport path 22 are arranged in the transport path 22.

The document G nipped and fed by plural transport roll pairs 28 temporarily gets out of the document transport apparatus 20, is nipped with respect to a reading window portion 42 of the image reading portion 30, and is thereafter entered again into the document transport apparatus 20 by a document scooping member 40 provided in the image reading portion 30 and having a triangular cross sectional shape.

The document G fed into the document transport apparatus 20 is transported by the transport roll pair 28, and is thereafter delivered to the output portion 19 by a delivery roll pair 29.

In the case of reading the image of the document G transported by the transport roll pair 28, the image input portion 36 moves to a lower side of the reading window portion 42, and the image of the document G passing the above of the reading window portion 42 is read by an image reading device 38 via the image input portion 36 and the contracting optical system 34.

Further, the image reading portion 30 is structured such that a top surface thereof is constructed as a document table 32 or the like mounting the document G thereon and made of a glass or the like.

The document transport apparatus 20 is attached to the image reading portion 30 so as to be openable and closeable, and is used as a pressing cover pressing the document G mounted on the document table 32. In other words, the document transport apparatus 20 is open with respect to the image reading portion 30, the document G is mounted on the document table 32, and the document G is pressed by closing the document transport apparatus 20. In this case, the document G is put in such a manner that a document surface is directed to the document table 32 side (a downward side).

In the case of reading the image of the document G mounted on the document table 32, the image of the document G mounted on the document table 32 is read by the image reading device 38 via the image input portion 36 and the contracting optical system 34 while moving image input potion 36 in the horizontal direction.

(Structure for Attaching and Detaching Separation Roll 15 to and from Document Transport Apparatus 20)

Next, a description will be given of a structure for attaching and detaching the separation roll 15 to and from the document transport apparatus 20.

Figure 2:
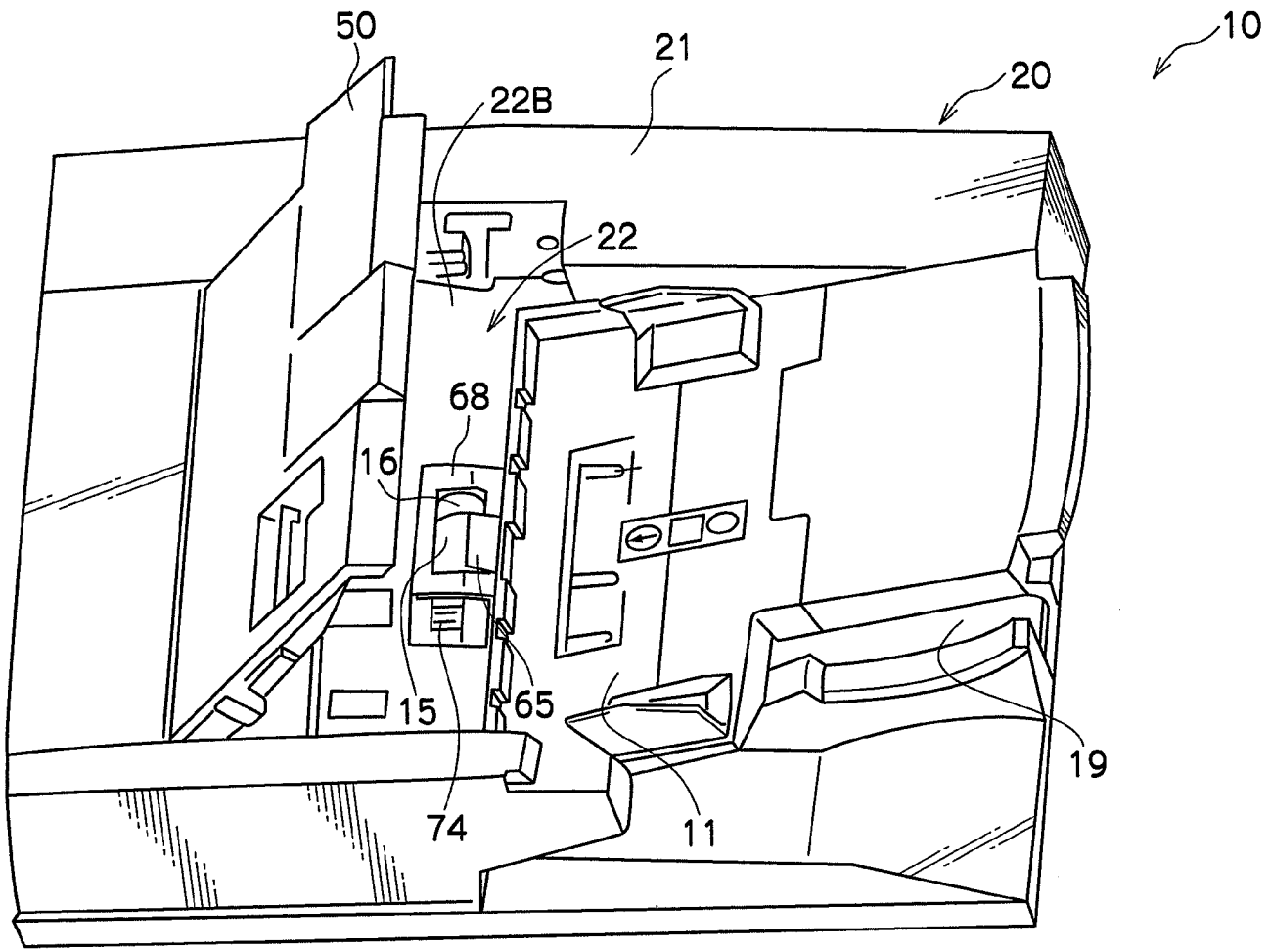
FIG. 2 is a perspective view showing a structure of a document transport apparatus and showing a state in which a cover body is opened.

FIG. 2 is a view showing the structure of the document transport apparatus and a perspective view showing a state in which a cover body is opened.

The document transport apparatus 20 of the image reading apparatus 10 comprises a document transport apparatus main body 21, and a cover body 50 for releasing a transport path 22, as shown in FIG. 2.

The cover body 50 is rotatably attached to the document transport apparatus main body 21. In the cover body 50, an upper transport path surface 22A being one transport path surface of the transport path 22 is formed, and the delivery roll 13 and the transport roll 14 are arranged (refer to FIG. 1).

On the other hand, a lower side transport path surface 22B being the other transport path surface of the transport path 22 is formed in the document transport apparatus main body 21, and the separation roll 15 is arranged therein.

The transport path surface 22B formed in the document transport apparatus 21 and the transport path surface 22A formed in the covey body 50 come apart from each other by rotating the cover body 50 with respect to the document transport apparatus main body 21. Then, the transport path is opened, and the transport roll 14 and the separation roll 15 come apart from each other. Accordingly, the transport path surface 22B, the separation roll 15 and a cover 68 described below formed in the apparatus main body 12 are exposed.

The document transport apparatus 20 comprises a support body 56 rotatably supporting the separation roll 15. The support body 56 is formed by a frame body surrounding the separation roll 15 as shown in FIGS. 3 and 4. The support body 56 is arranged in both end sides in an axial direction of the separation roll 15, and is provided with a pair of support plates 56A rotatably supporting the separation roll 15. In this case, the torque limiter 16 is attached to the rotation axis of the separation roll 15, and the torque limiter 16 is arranged within the frame of the support body 56.

An overhanging portion 56B overhanging toward an outer side in the axial direction of the separation roll 15 is formed in an upper portion of the support plate 56A. A grip portion 56C for gripping the support body 56 is formed in the overhanging portion 56B. The grip portion 56C is formed by a part of the overhanging portion 56B being cut away towards an inner side in the axial direction of the separation roll 15. In the exemplary embodiment, the structure is made such that it is not necessary to directly grip the separation roll 15, by gripping the grip portion 56C when attaching and detaching the separation roll 15.

A protrusion portion 56D protruding to an outer side in the axial direction of the separation roll 15 is formed in an outer surface of a lower portion of one support plate 56A, as shown in FIG. 4. The other support plate 56A is formed in a taper shape in which a lower end portion is tapered, as shown in FIG. 5.

The pair of support plates 56A are connected to a pair of connecting portions 56E which are arranged along a part of an outer periphery of the separation roll 15 and extend in the axial direction of the separation roll 15. The connecting portions 56E suppress contact with an outer periphery of the separation roll 15 when replacing the separation roll 15.

The support plate 56A, the overhanging portion 56B, the protrusion portion 56D and the connecting portions 56E are integrally formed.

The transport path 22 along which the document G is transported is provided with an accommodation container 58 which can accommodate the separation roll 15 and the support body 56, as one example of a separation roll accommodation portion which detachably accommodates the separation roll 15 and the support body 56 from the transport surface side of the transport path 22.

The separation roll 15 and the support body 56 are structured so as to be integrally accommodated in the accommodation container 58, and the separation roll 15 and the support body 56 constitute the separation roll unit which is handled integrally.

The accommodation container 58 is provided with a bottom surface 58A which is curved as a circular arc shape along an outer periphery of the separation roll 15, and a pair of side plates 58B which are formed as a semicircular shape. The bottom surface 58A and a pair of side plates 58B are integrally formed.

Further, the accommodation container 58 is open to an upper side, that is, to a transport path surface side, and the separation roll 15 and the support body 56 are accommodated in such a manner as to be dropped down from the open upper portion into the accommodation container 58.

As shown in FIG. 5, since the accommodation container 58 is snugly inserted in an opening portion 73, there is no vacant space in the opening portion 73 after the accommodation container is mounted. Accordingly, the accommodation container 58 can prevent material from dropping into the inner portion of the apparatus from the separation roll accommodation portion.

A pair of plate bodies 59 arranged along a document transport direction A are provided within the accommodation container 58, as shown in FIG. 5. In one plate body 59, there is formed an insertion groove 59A in which the protrusion portion 56D, formed in the outer surface in the lower portion of the one support plate 56A, is inserted.

The insertion groove 59A is formed in a taper shape in which an upper end is made wider, and a far side (a lower end portion) of the insertion groove 59A is formed to be a fitting portion 59C to which the protrusion portion 56D is fitted. The protrusion portion 56D is guided to the far side of the insertion groove 59A by an inclined surface of the tapered insertion groove 59A, and is fitted to the fitting portion 59C in the far side of the insertion groove 59A, and the position of one end portion of the support body 56 is thereby set.

An insertion groove 59B into which the other tapered support plate 56A is inserted is formed in the other plate body 59. The insertion groove 59B is formed as a taper shape in which an upper end is made wider, and a far side (a lower end portion) of the insertion groove 59B is formed as a fitting portion 59D to which the other tapered support plate 56A is fitted.

The other tapered support plate 56A is guided to a far side of the insertion groove 59B by an inclined surface of the tapered insertion groove 59B, and is fitted to the fitting portion 59D in a far side of the insertion groove 59B, and the position of the other end portion of the support body 56 is thereby set.

In this case, the separation roll 15 is pressed downward by the fed document G, when feeding the document G, and is pressed to the accommodation container 58 side. Accordingly, the support body 56 is maintained in a state in which it is positioned in the accommodation container 58, and it is not necessary to fix the support body 56 to prevent it from moving.

Further, the accommodation container 58 functions as an inner cover that closes an opening which connects with the inner portion of the document transport apparatus 20.

The document transport apparatus 20 is provided with a support frame 60 as one example of a support member which rotatably supports the accommodation container 58 (refer to FIG. 4).

A shaft 62 inserted in a through hole 63 formed in the accommodation container 58 is fixed to the support frame 60, and the accommodation container 58 is made freely rotate with respect to the support frame 60.

Further, the document transport apparatus 20 is provided with a tension spring 64 as one example of a pressing member which biases the cover 68 in a lifting-up direction of the cover 68 from the transport path surface, as well as pressing the separation roll 15 to the document G fed from the document tray 11.

An attaching portion 66 to which one end portion of the tension spring 64 is attached is formed in a back surface side of the accommodation container 58. The accommodation container 58 in which the support body 56 and the separation roll 15 are accommodated is arranged at one side around the shaft 62 which corresponds to a center of rotation, and the attaching portion 66 is arranged at the other side. Thereby, the accommodation container 58 may be rotated upwards by pushing down the attaching portion 66.

One end portion of the tension spring 64 is attached to the attaching portion 66, and the other end portion of the tension spring 64 is fixed to the support frame 60. Accordingly, when the attaching portion 66 is pushed down, the accommodation container 58 is biased upward.

Due to the accommodation container 58 being biased upward, the separation roll 15 is biased towards the transport roll 14, and presses the document G which is fed from the document tray 11 so as to be guided to the nip portion N.

In this case, as a pressing member which allows the cover to be easily detached, a structure which biases the support body 56 upward in place of the accommodation container 58 may be employed. Further, the pressing member is not limited to the tension spring 64, and may employ a biasing member such as a leaf spring, a compression spring or the like.

Figure 6:
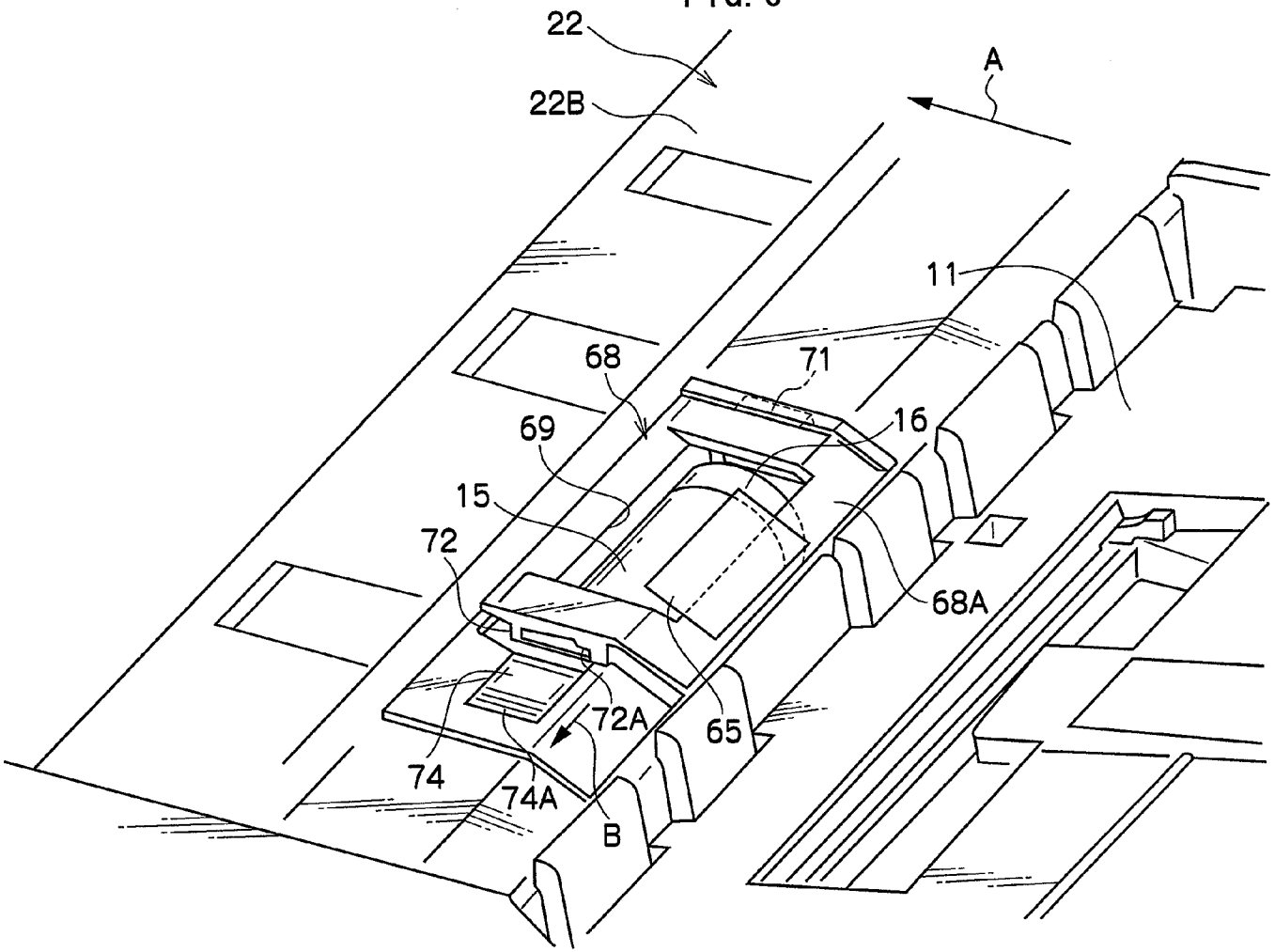
FIG. 6 is a perspective view showing a state in which a cover in accordance with the exemplary embodiment lifts up from a transport path surface.

A cover 68 having an opening 69 to which the surface of the separation roll 15 accommodated in the accommodation container 58 is exposed is detachably provided on the accommodation container 58, as shown in FIG. 6.

The cover 68 is provided on the accommodation container 58, and is used as a covering member covering over the accommodation container 58. Further, the cover 68 is formed as a frame body in a plate shape, and the opening 69 is formed in a center portion of the frame body.

One side (position) 68A in an upstream side of the document transport direction A of the frame body forming the cover 68 is inclined along the transport path surface, and a film 65 is attached to the one side (position) 68A so as to be directed to the opening 69 side.

The film 65 is used as a guide member guiding the document G to the nip portion N formed between the transport roll 14 and the separation roll 15.

The cover 68 is detachably provided in the transport path 22, and is structured so as to be attachable from an opening portion 73 formed in the transport path surface 22B. An installation portion for installing the cover 68 to the opening portion 73 is formed in an edge portion of the opening portion 73.

The installation portion is provided with a fitting groove 67 (refer to FIG. 7) to which is fitted a protruding portion 71 (refer to FIG. 6) formed in one end portion of the cover 68. The fitting groove 67 is arranged in an edge portion of the opening portion 73 at one end portion side (one end portion side in an axial direction of the separation roll 15 which is accommodated in the accommodation container 58) in a direction intersecting the document transport direction A.

Further, the installation portion is provided with a fitting piece 76 (refer to FIG. 7) protruding to a center portion of the opening portion 73 from the edge portion of the opening portion 73.

The fitting piece 76 is arranged at an edge portion of the opening portion 73 at the other end portion side (the other end portion side in the axial direction of the separation roll 15 which is accommodated in the accommodation container 58) in the direction intersecting the document transport direction A, and opposes the fitting groove 67.

The fitting piece 76 is biased in a direction in which the fitting piece 76 protrudes toward a center portion of the opening portion 73 from the edge portion of the opening portion 73, by a biasing member such as a spring or the like (not shown).

An operation portion 74 for carrying out an operation of detaching the cover 68 is provided on the transport path surface, and by operating the operation portion 74, the fitting piece 76 is withdrawn to an edge portion of the opening portion 73 so as to resist the biasing force of the biasing member.

A protruding piece 72 protruding from the cover 68 is formed in the other end portion of the cover 68 (refer to FIG. 6). A fitting hole 72A is formed in the protruding piece 72. The fitting piece 76 formed in the edge portion of the opening portion 73 and protruding thereto is fitted to the fitting hole 72A, and the cover 68 is thereby installed to the opening portion 73.

A rib 74A that provides grip to a finger when operating the operation portion 74 is formed on the operation portion 74 along the document transport direction A. When an operator slides the operation portion 74 in an intersecting direction B intersecting the document transport direction by using the rib 74A to grip their finger, the fitted state between the fitting hole 72A and the fitting piece 76 is released, and the cover 68 may be detached from the opening portion 73.

The rib 74A is formed along the document transport direction A, and functions as a transport rib that contacts the document G which is fed along the transport path 22. The transport rib reduces a transport resistance applied to the fed document G, by reducing a contact area between the document G and the transport path surface.

In other words, the rib 74A that provides grip to a finger when operating the operation portion 74 does not easily impart transport resistance to the fed sheet.

The cover 68 installed at the opening portion 73 forms a part of the transport path surface, and retains the support body 56 so as to prevent the support body 56 and the separation roll 15 from being detached from the accommodation container 58.

Further, since the accommodation container 58 is biased upward, the cover 68 is biased in a lifting-up direction with respect to the transport path surface.

Accordingly, the fitted state of the cover 68 is released with respect to the fitting hole 72A and the fitting piece 76, and it lifts up from the transport path surface when detaching the cover 68 from the opening portion 73.

In this case, the exemplary embodiment is structured so as to be provided with the accommodation container 58, however, the structure may be made, for example, such that a retaining portion retaining the end portion of the support body 56 is provided at each of both sides of the edge portion of the opening portion 73, that is, each of the positions at which the fitting piece 76 and the fitting groove 67 are arranged, without providing the accommodation container 58.

Figure 8:
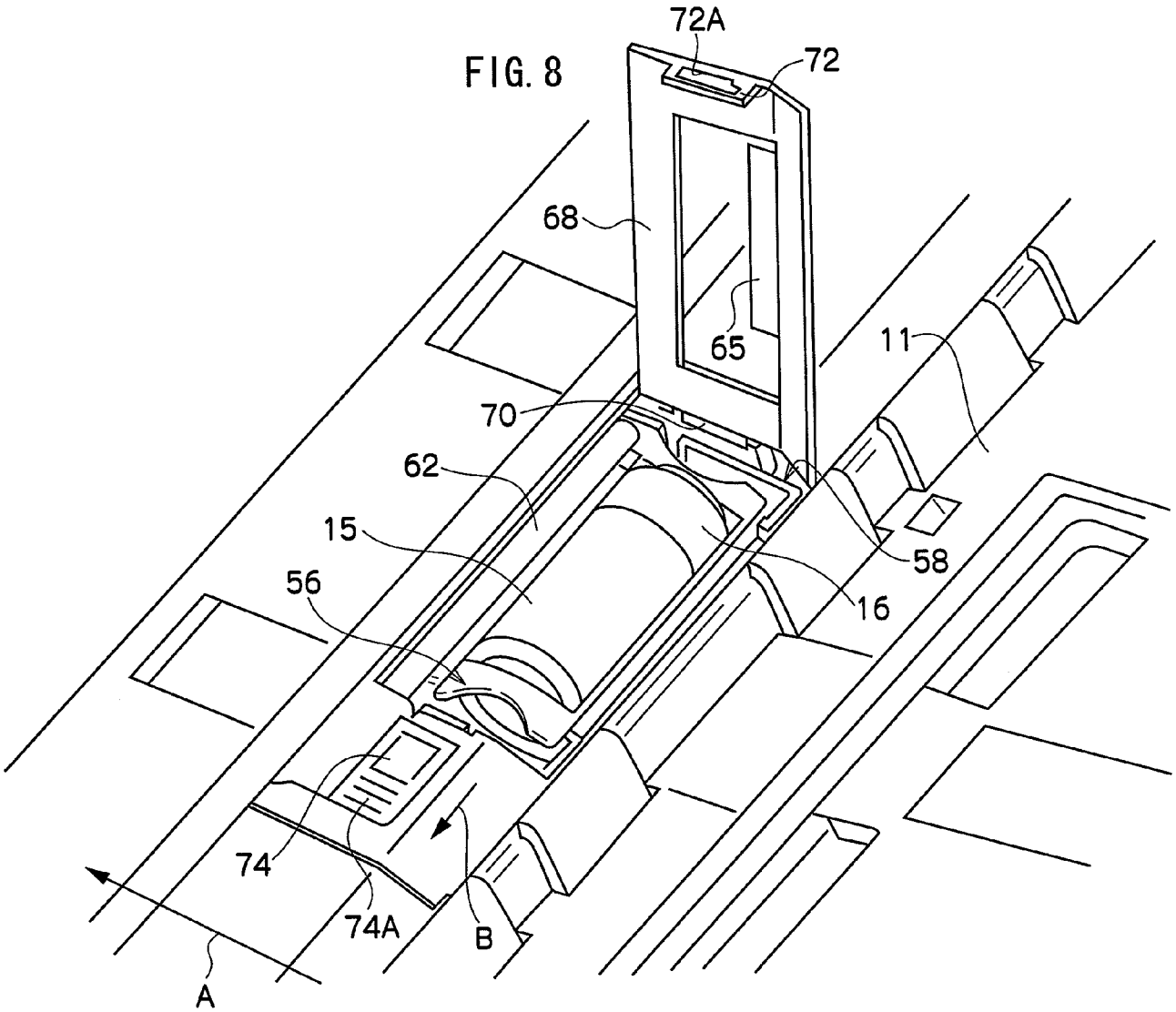
FIG. 8 is a view showing a modified example in which a hinge is provided in the cover in accordance with the exemplary embodiment.

Further, the cover 68 may be structured, as shown in FIG. 8, so that one side of the cover 68 is attached to the transport path surface via a hinge 70, and be rotated by the hinge 70 so as to be opened and closed.

Figure 9:
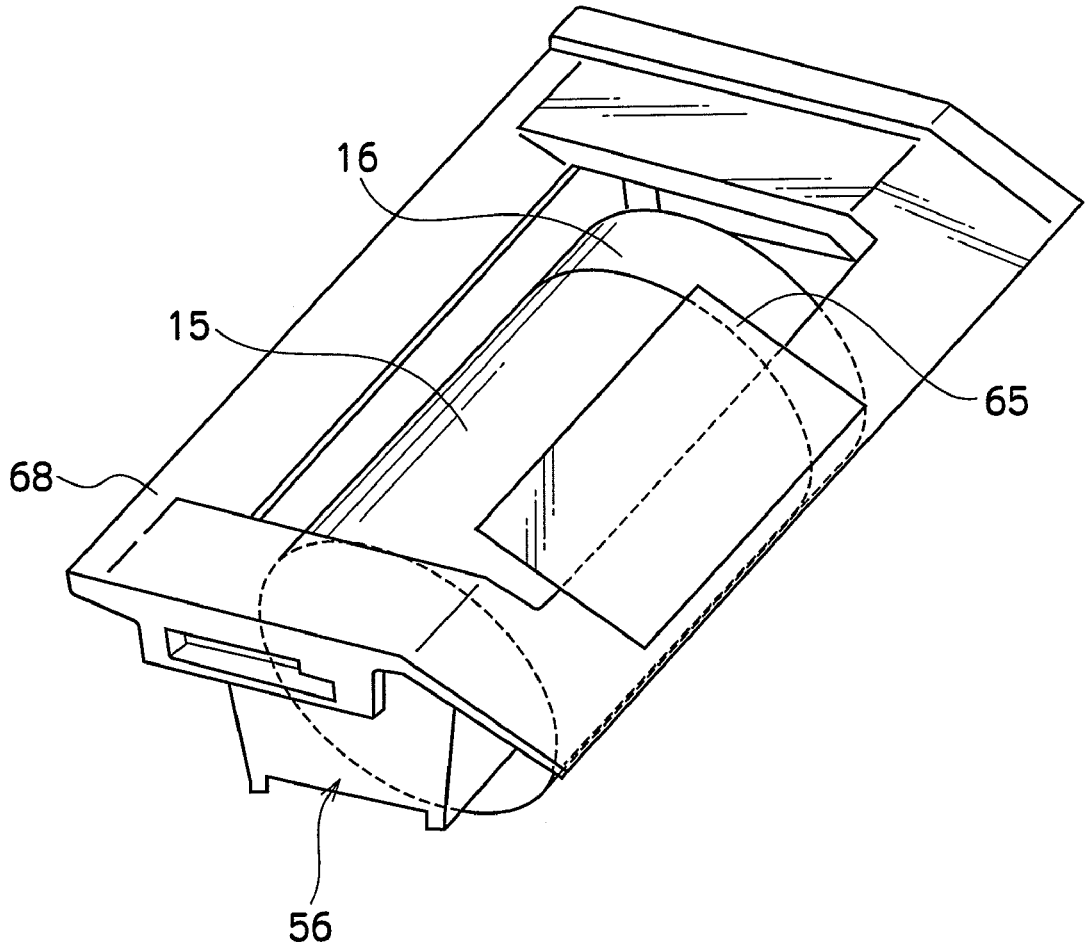
FIG. 9 is a view showing a modified example in which the support body and the cover in accordance with the exemplary embodiment are integrally structured.

Further, the structure may be made, as shown in FIG. 9, such that the cover 68 and the support body 56 are integrally formed, and the cover 68 and the support body 56 are integrally installed to the transport path 22.

(Operation of Exemplary Embodiment)

Next, a description will be given of an operation of the exemplary embodiment mentioned above.

In the exemplary embodiment, the cover body 50 is first opened as shown in FIG. 2, at a time of replacing the separation roll 15. Accordingly, the transport path 22 is opened, and the separation roll 15 is exposed.

Next, the finger is got caught in the rib 74A of the operation portion 74, and the operation portion 74 is slid to the intersecting direction B.

Accordingly, the fitting piece 76 is evacuated from the fitting hole 72A of the cover 68, and the fitting state between the fitting hole 72A and the fitting piece 76 is released. If the fitting state between the fitting hole 72A and the fitting piece 76 is released, the cover 68 is lifted up from the transport path surface by the tension spring 64, as shown in FIG. 6.

Figure 7:
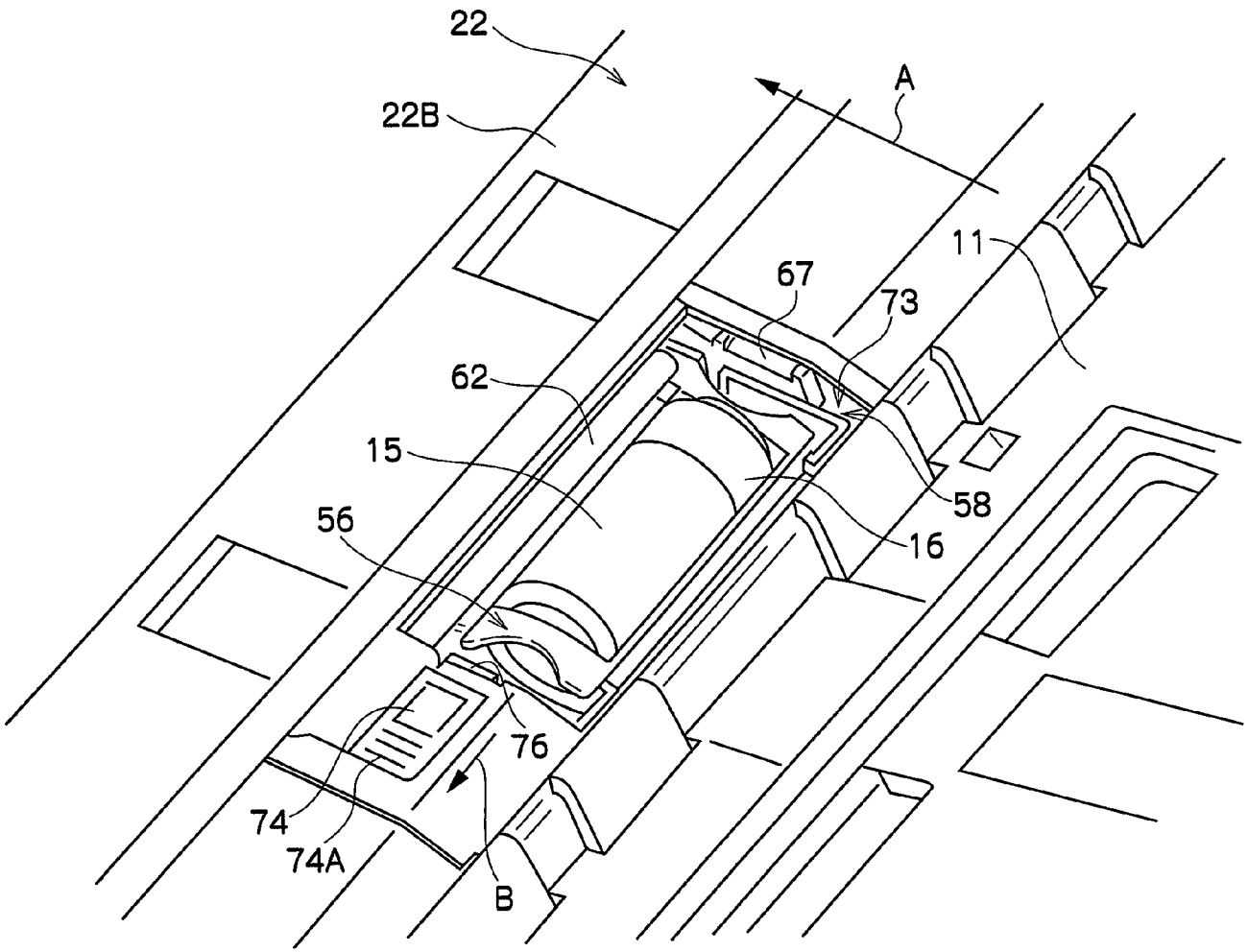
FIG. 7 is a perspective view showing a state in which the cover in accordance with the exemplary embodiment is detached from the transport path surface.

Next, the cover 68 is detached from the opening portion 73 of the transport path surface, as shown in FIG. 7. Next, the separation roll 15 is detached from the accommodation container 58 from the transport path surface 22B side, by gripping the gripping portion 56C of the support body 56 without directly holding the separation roll 15.

Next, the new separation roll 15 is accommodated in such a manner as to be dropped down from the transport path surface 22B side into the accommodation container 58. Next, the cover 68 is installed to the opening portion 73 of the transport path surface, and the cover body 50 is closed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit;

a separation roll accommodation portion formed in a transport path along which the sheets are transported, and accommodating the support body supporting the separation roll such that the support body supporting the separation roll is detachable from a transport surface side of the transport path;

a cover detachably provided at the separation roll accommodation portion and having an opening exposing a surface of the separation roll accommodated in the separation roll accommodation portion; and a pressing member that presses the separation roll to the sheet fed from the sheet supply tray and lifts up the cover from the transport path surface.

2. The sheet transport apparatus of claim 1, further comprising:

an operation portion provided on the transport path surface that performs an operation of detaching the cover; and a rib formed on the operation portion in the direction of the feeding sheet.

3. The sheet transport apparatus of claim 1, wherein the cover is attached to the separation roll accommodation portion by a hinge, and is rotated by the hinge so as to be opened and closed.

4. The sheet transport apparatus of claim 1, wherein the cover and the support body are integrally formed.

5. The sheet transport apparatus of claim 1, wherein the separation roll rotates around an axis during the transportation of the sheets, and wherein the separation roll and the support body are detachable in a direction which is not an axial direction of the axis around which the separation roll rotates.

6. The sheet transport apparatus of claim 1, wherein the separation roll rotates around an axis during the transportation of the sheets, and wherein the separation roll and the support body are detachable in a direction which is substantially orthogonal to an axial direction of the axis around which the separation roll rotates.

7. A sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit; and a separation roll accommodation portion formed in a transport path along which the sheets are transported, and accommodating the support body supporting the separation roll such that the support body supporting the separation roll is detachable from a transport surface side of the transport path, wherein the separation roll accommodation portion is a container which closes an opening connected with the inner portion of the apparatus and which is open to the transport path surface side.

8. The sheet transport apparatus of claim 7, wherein the separation roll rotates around an axis during the transportation of the sheets, and wherein the separation roll and the support body are detachable in a direction which is not an axial direction of the axis around which the separation roll rotates.

9. The sheet transport apparatus of claim 7, wherein the separation roll rotates around an axis during the transportation of the sheets, and wherein the separation roll and the support body are detachable in a direction which is substantially orthogonal to an axial direction of the axis around which the separation roll rotates.

10. A sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit; and a separation roll accommodation portion formed in a transport path along which the sheets are transported, and accommodating the support body supporting the separation roll such that the support body supporting the separation roll is detachable from a transport surface side of the transport path, wherein a torque limiter is attached to a rotation shaft of the separation roll.

11. The sheet transport apparatus of claim 10, wherein the separation roll rotates around an axis during the transportation of the sheets, and wherein the separation roll and the support body are detachable in a direction which is not an axial direction of the axis around which the separation roll rotates.

12. The sheet transport apparatus of claim 10, wherein the separation roll rotates around an axis during the transportation of the sheets, and wherein the separation roll and the support body are detachable in a direction which is substantially orthogonal to an axial direction of the axis around which the separation roll rotates.

13. The sheet transport apparatus of claim 10, wherein the support body has a pair of support plates supporting the separation roll at both end sides in an axial direction of an axis about which the support body rotates, and wherein a torque limiter is attached to a rotation shaft of the separation roll and is provided between the pair of support plates in the axial direction.

14. A sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit; and a separation roll accommodation portion formed in a transport path along which the sheets are transported, and accommodating the support body supporting the separation roll such that the support body supporting the separation roll is detachable from a transport surface side of the transport path, wherein the support body is formed of a frame body which integrally surrounds the separation roll, the frame body having a pair of support plates supporting the separation roll at both end sides in an axial direction of an axis about which the support body rotates, an overhanging portion overhanging toward an outer side of the separation roll in the axial direction, and a pair of connecting portions extending in the axial direction of the separation roll and connecting the pair of support plates.

15. The sheet transport apparatus of claim 14, wherein a grip portion cut away to an inner side of the separation roll in the axial direction is formed at the overhanging portion.

16. The sheet transport apparatus of claim 14, wherein the separation roll accommodation portion is provided with a pair of plate bodies to which the support body is fitted.

17. The sheet transport apparatus of claim 16, wherein a protrusion portion protruding to an outer side of the separation roll in the axial direction is formed at at least one of the pair of support plates, and the overhanging portion is inserted to an insertion groove formed in the plate body.

18. An image forming apparatus comprising:

a sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit; and a separation roll accommodation portion formed in a transport path along which the sheets are transported, and accommodating the support body supporting the separation roll such that the support body supporting the separation roll is detachable from a transport surface side of the transport path;

an image reading apparatus comprising an image reading portion that reads an image of the sheet transported by the sheet transport apparatus;

an image recording apparatus that records the image on a recording medium, on the basis of the image read by the image reading apparatus;

a cover detachably provided at the separation roll accommodation portion and having an opening exposing a surface of the separation roll accommodated in the separation roll accommodation portion; and a pressing member that presses the separation roll to the sheet fed from the sheet supply tray and lifts up the cover from the transport path surface.

19. The image forming apparatus of claim 18, wherein the sheet transport apparatus further comprising:

an operation portion provided on the transport path surface that performs an operation of detaching the cover; and a rib formed on the operation portion in the direction of the feeding sheet.

20. An image forming apparatus comprising:

a sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit; and a separation roll accommodation portion formed in a transport path along which the sheets are transported, and accommodating the support body supporting the separation roll such that the support body supporting the separation roll is detachable from a transport surface side of the transport path;

an image reading apparatus comprising an image reading portion that reads an image of the sheet transported by the sheet transport apparatus; and an image recording apparatus that records the image on a recording medium, on the basis of the image read by the image reading apparatus, wherein the separation roll accommodation portion of the sheet transport apparatus is a container which closes an opening connected with the inner portion of the apparatus and which is open to the transport path surface side.

21. A sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit; and a separation roll accommodation portion formed in a transport path along which the sheets are transported, and accommodating the support body supporting the separation roll such that the support body supporting the separation roll is detachable from a transport surface side of the transport path, wherein the separation roll rotates around an axis during the transportation of the sheets, wherein the separation roll has a pair of ends which are provided at a distance from each other along an axial direction of the axis around which the separation roll rotates, and wherein the support body supports the separation roll at both of the ends of the separation roll.

22. A sheet transport apparatus comprising:

a sheet supply tray for accommodating a plurality of sheets;

a separation roll that separates out the sheets one by one by applying a transport resistance to the sheets transported from the sheet supply tray;

a support body configured to rotatably support the separation roll such that the support body and the separation roll are detachable as one unit; and a separation roll accommodation portion formed in a transport path along which the sheets are transported, and accommodating the support body supporting the separation roll such that the support body supporting the separation roll is detachable from a transport surface side of the transport path, wherein the separation roll rotates around an axis during the transportation of the sheets, and wherein a space is not provided at a distance away from the separation roll in an axial direction of the axis around which the separation roll rotates which allows the separation roll to move in the axial direction while being detached.

* * * * *